United States Patent [19]

Matsumoto

[11] 4,160,565

[45] Jul. 10, 1979

[54] SEAT BELT DEVICE

[75] Inventor: Katsuhiko Matsumoto, Kunitachi, Japan

[73] Assignee: Honda Giken Kogyo Kabushiki Kaisha, Tokyo, Japan

[21] Appl. No.: 821,994

[22] Filed: Aug. 5, 1977

[30] Foreign Application Priority Data

Aug. 31, 1976 [JP] Japan ..... 51-116604[U]

[51] Int. Cl.[2] ..... A62B 35/00; A44B 17/00

[52] U.S. Cl. ..... 297/483; 24/206 R; 297/468

[58] Field of Search ..... 297/389, 385; 24/241 PS, 241 SB, 206 R, 124; 280/745, 747, 744; 244/122 B

[56] References Cited

U.S. PATENT DOCUMENTS

| | | | |
|---|---|---|---|
| 3,112,496 | 12/1963 | Dritz | 24/206 R |
| 3,179,997 | 4/1965 | Jalinaud | 24/241 SB |
| 3,436,795 | 4/1969 | Hill | 24/241 PS |
| 3,457,603 | 7/1969 | Romanzi, Jr. et al. | 24/241 PS |
| 3,706,117 | 12/1972 | Axisa | 24/206 R |
| 3,844,001 | 10/1974 | Holmberg | 297/389 |
| 3,883,053 | 5/1975 | Pritchard | 297/389 X |
| 3,920,265 | 11/1975 | Nilsson | 297/389 X |
| 3,956,802 | 5/1976 | Kanzaka | 24/206 R |

FOREIGN PATENT DOCUMENTS

| | | | |
|---|---|---|---|
| 2327547 | 12/1973 | Fed. Rep. of Germany | 297/389 |
| 1202846 | 4/1970 | United Kingdom | 297/389 |

*Primary Examiner*—James T. McCall

*Attorney, Agent, or Firm*—Irving M. Weiner; Pamela S. Austin; Melvin Yedlin

[57] ABSTRACT

A tongueless type seat belt having a grip which is slidably affixed to the belt to protect the hand of the user when pulling out the belt, to prevent any twisting of the belt, and to be readily locked and unlocked with a tongueless buckle with a one-touch operation. On one end the belt is fixed to a portion of the car, and at the other end it is wound up in a retractor. In the intermediate portion of the belt there is a belt grip for mating with a tongueless buckle. The belt grip is slidable in the lengthwise direction of the belt and encloses the belt. The belt is made so that the front and back surfaces are readily distinguishable from each other.

14 Claims, 13 Drawing Figures

FIG. 4
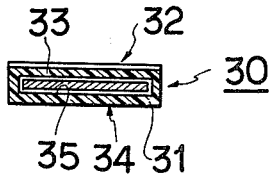
FIG. 5
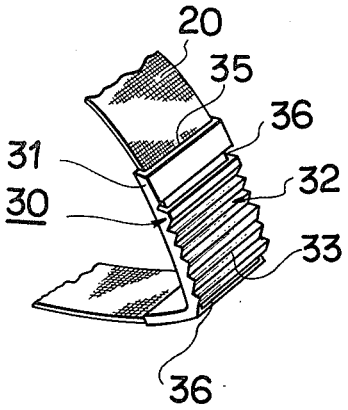
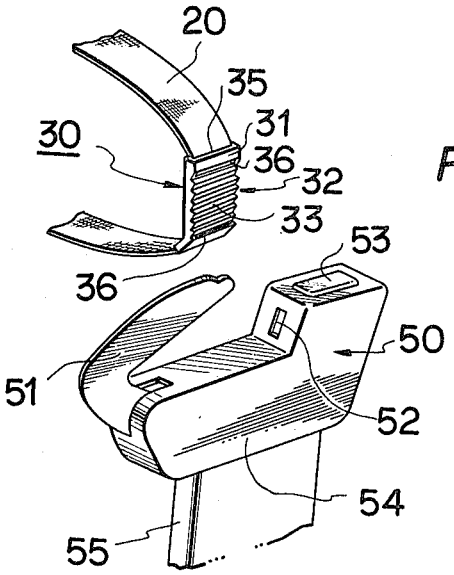
FIG. 6
FIG. 7
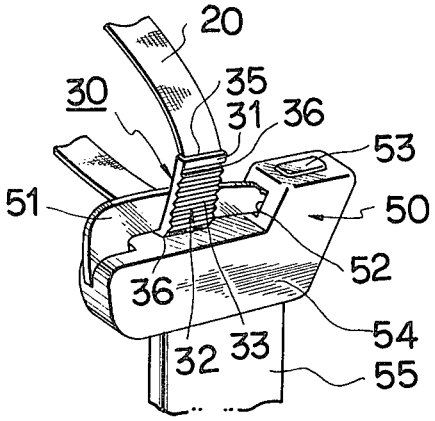

SEAT BELT DEVICE

The present invention relates to tongueless type seat belt devices having no tongue and buckle.

More particularly, the present invention relates to a tongueless type seat belt device provided slidably with a grip to make it possible to protect the hand when pulling out the belt, to prevent any twisted fitting of the belt, and to fit the seat belt to the tongueless buckle with a one-touch operation.

BACKGROUND OF THE INVENTION

A one-belt type seat belt device having to tongue and buckle is known, for example, from U.S. Pat. No. 3,844,001. Its summary is as shown and explained hereinbelow with reference to FIG. 13.

Because the conventional seat belt is made of thin cloth, it is not only difficult to operate, but also the front surface and back surface of the belt are difficult to discern from each other. Therefore, the belt is likely to be twisted by mistake, and the fitted belt is likely to rise in the twisted portion and hurt the neck or other part of the rider.

Further, the operation of fitting this kind of conventional seat belt device to a tongueless buckle in locking requires two steps, viz., the operation of inserting the seat belt, and the operation of locking the inserted belt. These operations are difficult and complicated.

Also, when inserting the seat belt in the tongueless buckle, because the belt is thin and is made of cloth, it will flex when it is inserted. Thus, a one-touch type tongueless buckle which can be automatically locked and fitted by only the inserting operation can not be achieved with the conventional components and structure.

SUMMARY OF THE INVENTION

The present invention provides a one-belt type tongueless seat belt device, which includes a belt that is fixed at one end thereof. The belt is wound up at the other end thereof so as to be free to pay out. The belt is payed out to be fitted and locked in its intermediate portion with a tongueless buckle so as to press the shoulder, breast and waist of a person using the belt. A belt grip is fitted with the belt to be slidable in the lengthwise direction of the belt so as to enclose the belt.

An object of the invention is to provide a one-belt type tongueless seat belt device wherein a grip is slidably fitted and set on the seat belt.

Therefore, an object of the invention is to provide a seat belt fitting wherein the seat belt is pulled out by gripping a grip without directly gripping the belt. The belt to be pulled out is slid within the grip instead of by hand to protect the hand and fingers at the time of pulling out the belt, to prevent the rubbing of the hand and fingers at the time of pulling out the belt and the scratching caused thereby, and to make the operation of pulling out the belt easy, safe and positive.

An object of the invention is to provide a seat belt fitting wherein one of the front and back surfaces of a grip is made different from the other surface so that the front and back surfaces may be easily distinguishable from each other. The belt is accurately fitted, and the twisted fitting of the belt, rising of the belt thereby and hurting the neck and other parts of the user are prevented.

A further object of the invention is to provide a seat belt device including a tongueless buckle device wherein, as the seat belt is provided with a belt grip, the rigidity of the side of the belt is great in the grip part. Therefore, the belt can be easily fitted by the operation of inserting it into the tongueless buckle from the side through the grip. The belt can also be fitted and locked by a one-touch operation by only the operation of inserting the belt.

Another object of the invention is to provide a seat belt device including a tongueless buckle device wherein the seat belt can be fitted and locked by a one-touch operation by only the operation of inserting a belt grip to make the seat belt fitting operation simple and easy.

BRIEF DESCRIPTION OF THE DRAWINGS

FIG. 4 is a sectioned view on line 4—4 in FIG. 2.

FIG. 5 is a perspective view of the belt grip in bent configuration.

FIG. 6 is a perspective view of a tongueless buckle just before being fitted.

FIG. 7 is a perspective view of the FIG. 6 device as fitted.

DETAILED DESCRIPTION

Figure 1:
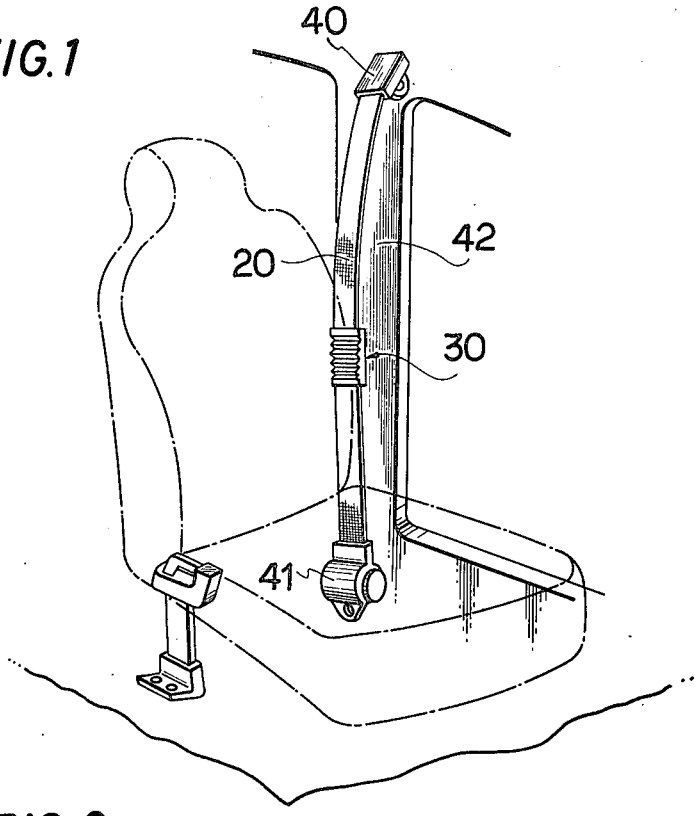
FIG. 1 is an explanatory perspective view showing the scheme of a seat belt device according to the present invention.

FIG. 1 shows a one-belt type seat belt 20 formed of cloth or the like. Belt 20 is secured at its upper end with an anchor 40 to the inside of a center pillar 42 in the upper part of a car body, and is wound and supported at its lower end with a retractor 41 fixed and provided in the lower part inside the car body to be able to be pulled out of the retractor. A winding reel may be used instead of the retractor.

Figure 2:
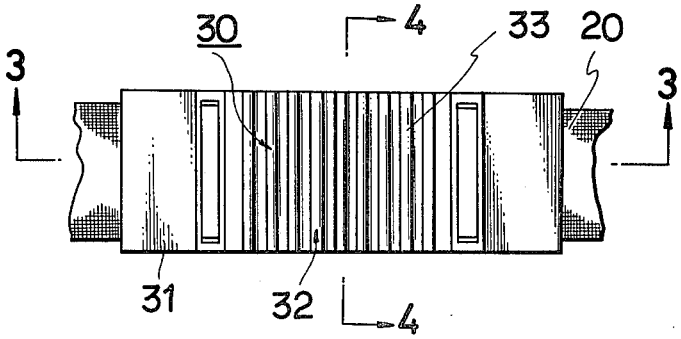
FIG. 2 is a plan view of the belt grip of FIG. 1.
Figure 3:
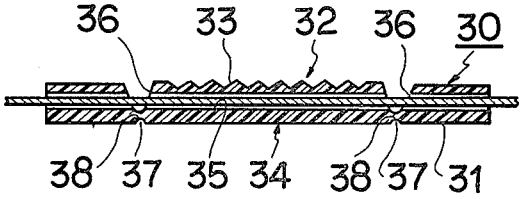
FIG. 3 is a sectioned view on line 3—3 in FIG. 2.
Figure 8:
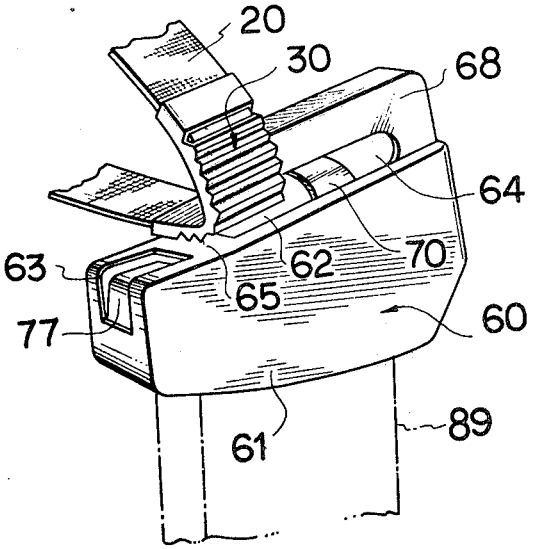
FIG. 8 is a perspective view showing the scheme of a one-touch type tongueless buckle according to the present invention as the belt is inserted.
Figure 9:
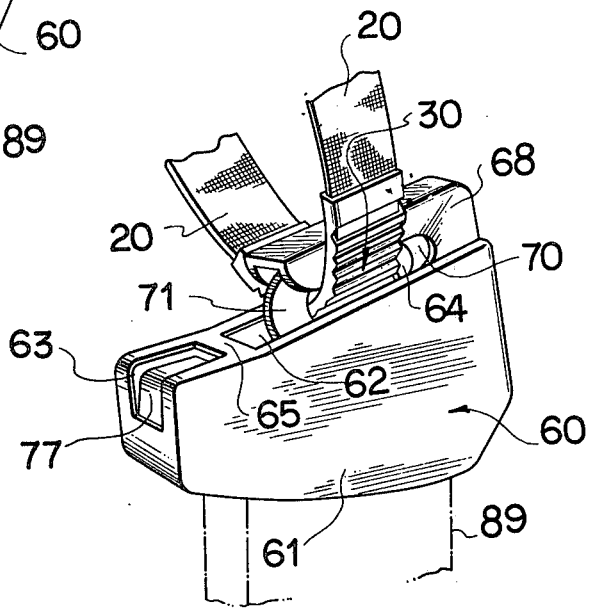
FIG. 9 is a view showing the belt as completely inserted and fitted in the FIG. 8 device.

A belt grip 30 is fitted to belt 20 as shown in FIGS. 2 and 3. A body 31 of the belt grip 30 has a suitable length in the lengthwise direction of the belt 20. A through hole 35, larger than the cross-sectional area of belt 20, is formed as shown in FIG. 4 through the cross-section of belt grip 30. The cross-section of hole 35 is formed to be rectangularly tubular. Belt 20 is fitted and inserted in hole 35, and the grip 30 is formed to slidably enclose the outer periphery of the belt in the lengthwise direction.

Body 31 of belt grip 30 is integrally molded of plastic, is preferably made flexible, and is provided on its surface 32 with a discerning part 33 consisting of corrugated continued concavo-convex parts in the illustrated embodiment so that surface 32 may be recognized as such due to the presence of this discerning part. The back surface 34 of belt grip 30 is made flat so as to be readily discernible from the surface 32 provided with the part 33. In this embodiment, the part 33 consisting of concavo-convexes is made on the surface. However, instead of the concavo-convexes, the surface 32 may be rough or knurly.

The belt grip 30 is molded of plastic to be flexible, but is formed as follows in order to be fitted to the tongueless buckle.

V-shaped notches 36 (FIG. 3) reaching the buttom of the hole 35 from the surface are formed laterally in the front and rear portions, respectively, of body 31. Concavities 37 are formed on the back surface of body 31 opposite to the valleys of notches 36 so that the parts between the concavities and valleys are thin to form hinge parts 38. Thus, the grip 30 will become flexible in its front and rear portions with parts 38 as hinges.

The operation of fitting the belt 20 having the above belt grip 30 shall be explained in the following.

FIGS. 6 and 7 show an embodiment of fitting the belt to a conventional tongueless buckle 50. The tongueless buckle 50 is arranged on the floor on the side part of a seat in a car body, and is provided with a hook 51 which is free to rise and fall. Hook 51 engages with a hole 52. A push button 53 for disengaging hook 51 and hole 52 is provided on a body 54 fixed to the upper end of a stay 55 projecting from the floor. The hook 51 is pivoted in its base part. The push button 53 is resiliently supported to be pushed down to unlock the hook 51 inserted at its tip in the engaging hole 52.

When belt 20 is pulled out toward the tongueless buckle by gripping and pulling the grip 30 by hand, the hand and fingers will not directly contact the belt 20. The belt 20 will be pulled out while sliding in the hole 35, and the hand and fingers will not be injured by rubbing with the belt. Also, because the belt 20 is pulled out by gripping the thick grip while sliding the belt in the grip 30 without gripping the thin belt 20, the operation of pulling out the belt 20 can be made easily and positively. Further, when pulling out the belt 20, and the discerning part 33 formed on the surface 32 of the grip 30 is recognized, the front and back surfaces of the belt 20 will not be mistaken for each other in pulling out the belt and fitting it to the tongueless buckle 50, therefore, while the belt 20 is fitted, it will not rise on the edge and will not injure the neck or other part of the occupant.

The grip 30 of the belt 20 pulled out is raised diagonally upward of the tongueless buckle 50 as shown in FIG. 6, is bent in the form of V, and is inserted in the released hook 51. In such case, by the action of the hinge parts 38 of the grip 30, the grip can easily be bent in both end parts to be in the form of V, and fitted to the hook 51.

The grip 30 is inserted below the hook 51, then hook 51 is pushed down to fall, and is engaged at its tip with the engaging hole 52. Grip 30 is pushed against the body 54 of the tongueless buckle with the hook 51, and is inserted and locked as shown in FIG. 7. Thus, the belt 20 will be held with the tongueless buckle 50 by means of grip part 30, and will press the shoulder, breast and waist of the occupant.

The fitted belt 20 can be released by pushing down the releasing button 53 to disengage the hook so that the hook 51 may return as shown in FIG. 6, and by pulling the belt grip 30 off of the hook 51.

Because the belt has the belt grip 30, the belt 20 can be pulled out and fitted safely, easily, positively and accurately.

In the above, the belt grip 30 is formed of plastic and is flexible in the lengthwise direction, but is relatively unflexible in the width direction of the belt 20.

Therefore, the belt grip 30 shows such high rigidity against side pressure that such a tongueless buckle which can fit the belt by a one-touch operation, as in the following, can be adopted.

FIGS. 8 to 12 show a novel tongueless buckle 60 which can fit and hold the seat belt 20 by a one-touch operation.

The tongueless buckle 60 consists of a relatively narrow plastic cover 61 and a metallic body 67 fitted in it. Buckle 60 is supported on a stem 89 rising from the floor. The body 67 is formed of a steel plate material, and is embedded for its major portion in the cover 61. Body 67 is provided in its rear portion with a hook part 68 projected upward from the rear end of a slot 62 opened and formed in the forward and rearward direction on the cover 61. Hook 68 has a clearance 64 made from the upper surface of the cover 61, and is extended forward to be parallel with the clearance. The body 67 including the hook part 68 is formed to be channel-shaped in section. The hook part 68 is open at its front end.

A catch lever 69 is pivoted with a pin 75 in the body 67 located within the cover 61. The pin 75 is provided to cross the body 67. The catch lever 69 is substantially U-shaped, is pivotally movable with the pin 75 as a fulcrum, and is set so that pawls 70 and 71 at both ends may face the slot 62.

A releasing lever 76, pivoted in its base end part with a pin 82, is provided within the body 67. Lever 76 is pivotally movable with the pin 82 as a fulcrum, and is provided at its tip with a flat pressing part 77 facing a hole 63 opening in the front end of cover 61. This hole 63 and the slot 62 are separated from each other with a section part 65. A spring supporting part 78 is provided on the lower edge of the pressing part 77. A spring 83 is compressed and fitted between part 78 and a spring receiving part 66 provided within the cover 61 opposed to part 78 to resiliently urge the pressing part 77 upwardly.

A spring 74 is connected at one end thereof with the catch lever 69, and is connected at the other end thereof with the pin 82.

The releasing lever 76 is provided with an arcuate slot 79 engaging with pin 75 of the catch lever 69 for guaranteeing the pivotal movement of the releasing lever 76. Lever 76 also has an arcuate slot 81 engaging with a pin 80 provided to project on the side surface of the catch lever 69. Below the catch lever 69, a stopper 84 contacting the edge of lever 69 is pivoted on a pin 85, and is provided with an operating piece 86 contacting the edge of lever 76 and is resiliently pressed upward by a spring 87.

Figure 10:
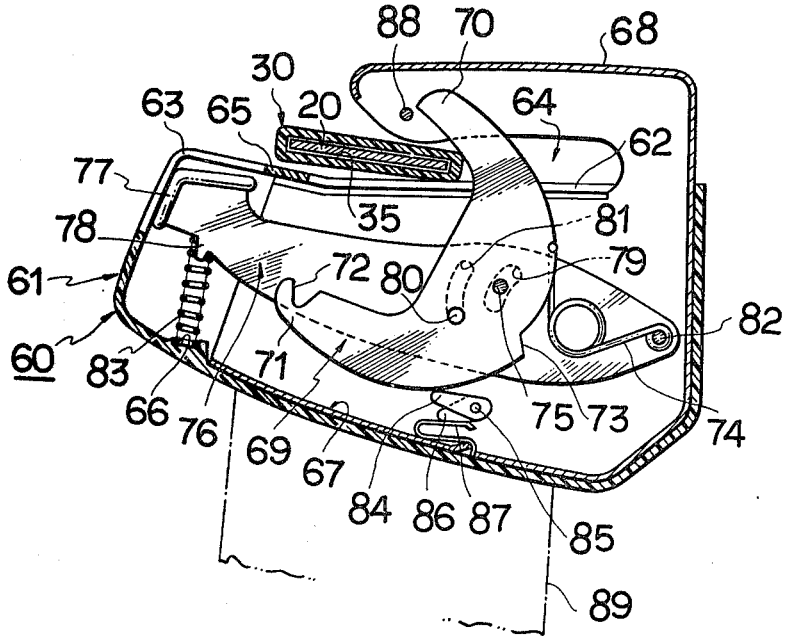
FIG. 10 is a vertically sectioned side view of the tongueless buckle, showing the internal mechanism and in the same condition as in FIG. 8.
Figure 11:
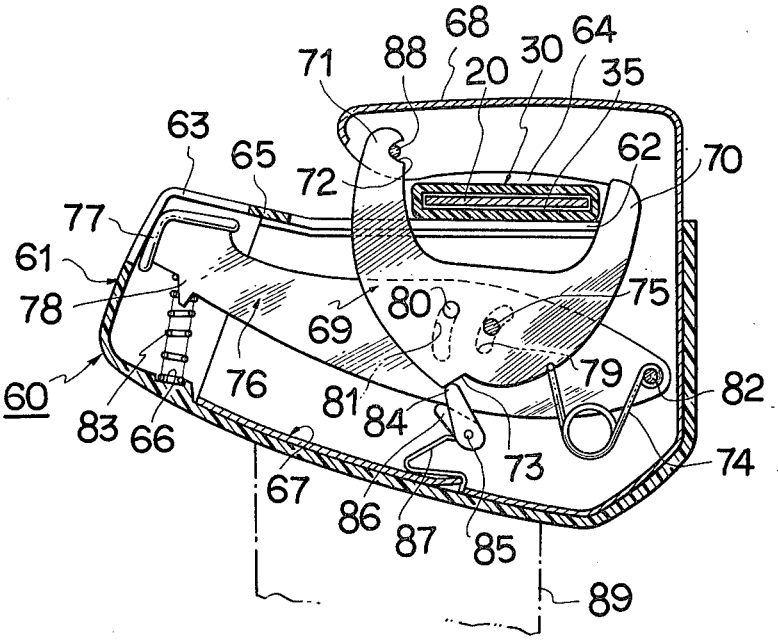
FIG. 11 is a vertically sectioned side view in the same condition as in FIG. 9.

As shown in FIG. 10, when the belt is released, the catch lever 69 will fall, and one pawl 70 will project above the slot 62 and will present its tip within the hook part 68 to close the inlet of the clearance 64. The belt 20 is pulled out by the grip 30.

The grip 30 is inserted on the side edge into the clearance 64 through the inlet as shown in FIG. 10. When the pawl 70 closing the inlet of the clearance 64 is pressed in the inserting direction by the side surface of grip 30, the catch lever 69 will pivotally move clockwise in FIG. 10 with the pin 75 as a fulcrum against the spring 74. Pawl 70 will move in the same direction, and the grip 30 will come into the clearance 64. With this pivotal movement of the catch lever 69, the other pawl 71 will project into the clearance 64 through the slot 62. An engaging concavity 72 formed in the tip of pawl 71 will be positioned in contact with a stopper pin 88 provided to cross the tip of hook part 68 to limit the pivotal movement of catch lever 69. In this state, the stopper 84 will engage with a stepped part 73 provided on the side edge of the catch lever 69 to hold lever 69 in this position against the resiliency of spring 74. Further, during the pivotal movement of the catch lever 69, because pin 80 engages in the slot 81 with the releasing lever 76, even if the catch lever 69 moves, the releasing lever 76 will not operate.

Thus, the pawls 70 and 71 will be present in the slot 62, and will be regulated and held between the lower surface of hook part 68 and the upper surface of cover 61 in the clearance 64 as shown in FIGS. 8, 9, 10 and 11. When the grip 30 is inserted, the belt 20 will be locked and held by the tongueless buckle 60 by one touch.

Figure 12:
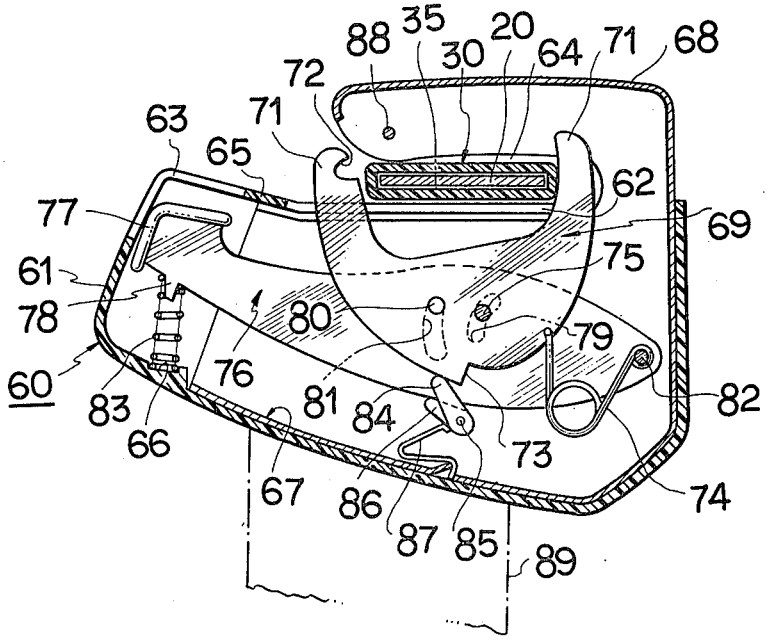
FIG. 12 is a vertically sectioned view of the belt as unlocked.

When releasing the grip 30 of the belt 20, the pressing part 77 facing the hole 63 is pushed down. Releasing lever 76 will pivotally move to fall with the pin 82 as a fulcrum. The operating piece 86 will be pushed down against the spring 87 and the stopper 84 integral with it will pivotally move to be disengaged from the stepped part 73 of catch lever 69 to release lever 69. The pin 80 will be guided by the slot 81 of the releasing lever 76 to more pivotally move. Catch lever 69 will be moved pivotally counterclockwise in the drawing by the expanding resiliency of the spring 74, and the pawl 71 will fall to open the inlet of the clearance 64. The pawl 70 will move leftwards in the drawing to push the grip 30 out of the clearance 64. This releasing process is shown in FIG. 12. Thus, the belt 20 including the grip 30 can be released by a one-touch operation.

Thus, by providing the seat belt with the above mentioned grip, the seat belt can be inserted into and removed from the tongueless buckle by a one-touch operation.

Figure 13:
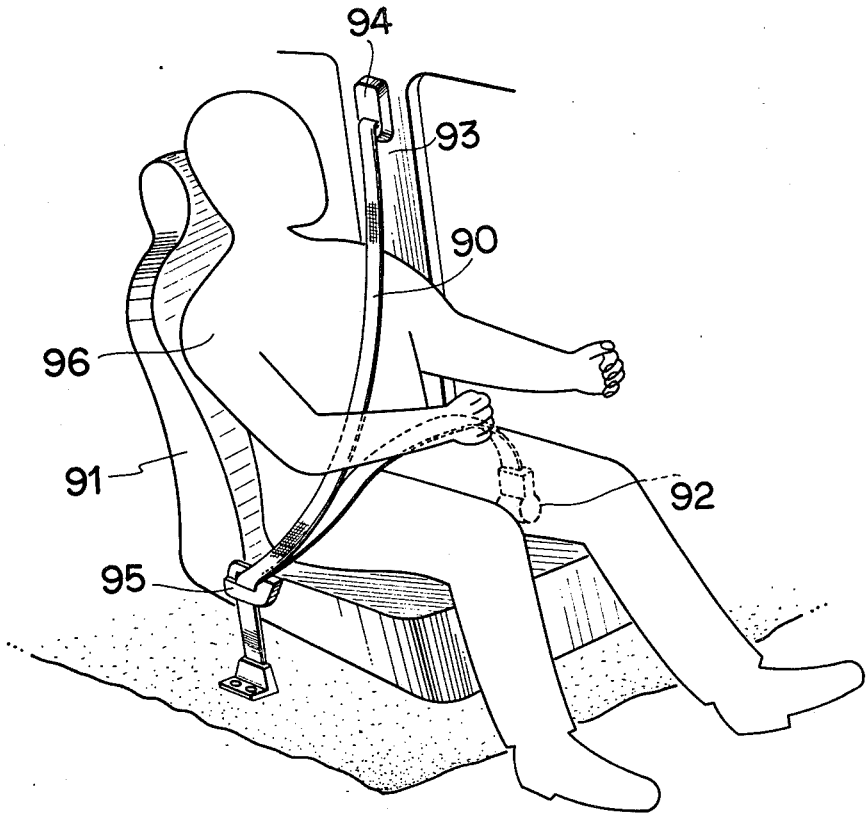
FIG. 13 is a perspective view showing the scheme of a conventional seat belt device.

As shown in FIG. 13, a seat belt 90 made of cloth or the like, of a seat 91, within a car body is secured at one end by means of a retractor 92. Belt 90 is secured at the other end to the upper inside of a center pillar 93 with an anchor 94 or the like. Belt 90 is pulled out and locked in its intermediate portion to a tongueless buckle 95 provided on the opposite side of the seat 91 to press the shoulder, breast and waist of a rider 96 sitting on the seat 91.

Thus, in the conventional one-belt type seat belt device, the seat belt 90 which is fixed at one end, and is free to pull out at the other end will be wound and housed in the retractor when it is not used. Belt 90 will have to be pulled out directly by the rider when it is to be used. Belt 90 will slide to rub the hand and fingers holding it when it is pulled out, and will hurt or scratch the hand and fingers unless the seat belt is carefully fed in the hand and fingers when pulling it out.

I claim:

1. A one-belt type tongueless seat belt device comprising:

a belt which is fixed at one end thereof;

said belt is wound up at the other end thereof so as to be free to pay out;

said belt is payed out to be fitted and locked in its intermediate portion with a tongueless buckle so as to press the shoulder, breast and waist of a person using said belt; and a belt grip fitted with said belt to be slidable in the lengthwise direction of said belt so as to enclose said belt;

said belt grip having hinge parts formed in the front and rear portions of said belt grip in the widthwise direction of said belt so as to be bent with said portion as hinges.

2. A seat belt device according to claim 1, wherein: said belt grip is so formed that its front and back surfaces may be easily and readily discernible from each other.

3. A seat belt device according to claim 2, wherein:

the back surface of said belt grip is formed to be flat; and the front surface of said belt grip is formed to be discernible by touch from said back surface of said belt grip.

4. A seat belt device according to claim 1, including:

a tongueless buckle having a U-shaped belt grip holding member;

said belt grip holding member being provided with a first pawl and a second pawl at its free ends;

said first pawl being a normally projected pawl in a clearance;

said second pawl being a normally retracted pawl in said clearance;

said pawls being regulated in their respective retracted and projected positions;

said belt grip holding member being free to pivotably move and being resiliently pressed, causing said normally retracted pawl to be retracted, and said normally projected pawl to be projected; and said belt grip holding member being pivotably supported such that upon inserting said belt grip into said clearance, said normally projected pawl may be pressed to pivotably move said belt grip holding member to cause said normally-retracted pawl to entrap, regulate and retain said belt grip within said clearance between said first pawl and said second pawl.

5. A seat belt device according to claim 4, wherein:

said tongueless buckle is provided with an engaging member to prevent the resilient return of said holding member while said holding member is regulated in the width direction of said belt grip.

6. A seat belt device according to claim 4, wherein:

said tongueless buckle is provided with an engaging means and releasing means operatively connected with a releasing member formed so that, while said holding member is regulated in the width direction of said belt grip, the pivotal movement by the resilient return of said holding member may be prevented and, by the operation of said releasing member, the prevention of the pivotal movement of said holding member may be released.

7. A seat belt device according to claim 4, wherein:

said tongueless buckle is provided with a U-shaped catch lever resiliently pressed in the returning direction to project one of said pawls in said clearance and to retract the other of said pawls;

said buckle is provided with a releasing lever pivoted at one end thereof and resiliently pressed at the other end thereof to operate only in the releasing direction a member regulating the pivotal movement of said catch lever so that, when said belt grip is inserted with its side edge in said clearance, the pawl projecting in said clearance may be pressed to pivotally move said catch lever and may be retracted to project the other pawl;

said belt grip may be regulated in its width direction between said pawls;

the pivotal movement of said catch lever may be regulated with said regulating member;

said belt grip may be held;

said regulating member may be released by the operation of said releasing lever; and said catch lever may be resiliently pressed and pivotally moved to push said belt grip out with one of said pawls.

8. A seat belt device according to claim 2, wherein:

a belt grip device having hinge parts formed in the front and rear portions of said belt grip in the lengthwise direction of said belt so as to be bent with said portions as hinges.

9. A seat belt device according to claim 1, wherein:

the back surface of said belt grip is formed to be flat; and the front surface of said belt grip is formed to be discernible by touch from said back surface of said belt grip.

10. A one-belt type tongueless seat belt device comprising:

a belt which is fixed at one end thereof;

said belt being wound up at the other end thereof so as to be free to pay out;

said belt being payed out to be fitted and locked in its intermediate portion with a tongueless buckle so as to press the shoulder, breast and waist of a person using said belt;

a molded plastic belt grip fitted with said belt to be slidable in the lengthwise direction of said belt so as to enclose said belt;

said belt grip having a lengthwise direction parallel to the lengthwise direction of said belt, and a widthwise direction perpendicular to said lengthwise direction;

said belt grip having a front surface, a front interior surface proximate said belt, and a back surface, and a back interior surface proximate said belt;

said belt grip being substantially inflexible;

said belt grip having hinge portions thereon;

each said hinge portions being formed by a notch in said front surface and a concavity in said back surface;

said notch in said front surface and said concavity in said back surface being disposed in opposition and alignment to each other, and parallel to said widthwise direction.

11. A seat belt device according to claim 10, wherein:

said hinge portion further includes a concavity in said back interior surface disposed in alignment with said notch and said concavity in said back surface.

12. A seat belt device according to claim 10, wherein:

said belt grip is so formed that its front and back surfaces may be easily and readily discernible from each other.

13. A seat belt device according to claim 12, wherein:

the back surface of said belt grip is formed to be flat; and the front surface of said belt grip is formed to be discernible by touch from said back surface of said belt grip.

14. A seat belt device according to claim 10, wherein:

the back surface of said belt grip is formed to be flat; and the front surface of said belt grip is formed to be discernible by touch from said back surface of said belt grip.

* * * * *